US007421966B2

(12) United States Patent
Boutaghou

(10) Patent No.: US 7,421,966 B2
(45) **Date of Patent: *Sep. 9, 2008**

(54) DEVICE FOR PROTECTING DOCK ANCHOR POSTS FROM ICE DAMAGE

(75) Inventor: Zine E. Boutaghou, North Oaks, MN (US)

(73) Assignee: Zine-Eddine Boutaghou, North Oaks, MN (US)

( * ) Notice: Subject to any disclaimer, the term of this patent is extended or adjusted under 35 U.S.C. 154(b) by 42 days.

This patent is subject to a terminal disclaimer.

(21) Appl. No.: 11/612,725

(22) Filed: Dec. 19, 2006

(65) Prior Publication Data

US 2007/0095269 A1 May 3, 2007

Related U.S. Application Data

(63) Continuation of application No. 11/289,735, filed on Nov. 29, 2005, now Pat. No. 7,150,241.

(60) Provisional application No. 60/631,520, filed on Nov. 29, 2004.

(51) Int. Cl.
*B63B 59/02* (2006.01)

(52) U.S. Cl. ..... 114/219; 405/211; 405/216; 405/217

(58) Field of Classification Search ..... 114/219; 405/211, 212, 213, 215, 216, 217
See application file for complete search history.

(56) References Cited

U.S. PATENT DOCUMENTS

| | | | | |
|---|---|---|---|---|
| 3,170,299 | A | 2/1965 | Clarke | |
| 3,370,432 | A | 2/1968 | Butler et al. | |
| 4,512,683 | A | 4/1985 | Cosenza | |
| 5,516,236 | A | 5/1996 | Williams et al. | |
| 6,357,377 | B1 | 3/2002 | Santelli | |
| 6,364,575 | B1 | 4/2002 | Bradley et al. | |
| 7,150,241 | B1 * | 12/2006 | Boutaghou | 114/219 |

* cited by examiner

*Primary Examiner*—Lars A. Olson

(57) ABSTRACT

A system for protecting a dock from ice damage. The system includes a circumferentially fluted, water-impermeable housing capable of longitudinal and radial expansion and contraction. The housing defines a cavity with upper and lower openings into the cavity through the housing. The openings are configured and arranged to engage a dock-supporting post at longitudinally spaced upper and lower points along the length of the post with the upper point positioned above the water line and the lower point positioned below the frost line.

1 Claim, 4 Drawing Sheets

DEVICE FOR PROTECTING DOCK ANCHOR POSTS FROM ICE DAMAGE

This is a continuation of U.S. patent application Ser. No. 11/289,735 filed Nov. 29, 2005, which claims the benefit of U.S. Provisional Application No. 60/631,520, filed Nov. 29, 2004.

BACKGROUND

Anchor posts employed in a body of water subject to freezing are susceptible to damage caused by the shifting of ice adhered to the posts. A common solution employed in many areas is removal of the dock and associated anchor posts from the water during the winter. While effective at preventing ice damage to the anchor posts, this procedure is labor intensive, time consuming and requires dry-land storage of the dock and anchor posts. In addition, seasonal removal of a dock and associated anchor posts may not be an available option in some circumstances.

Accordingly, a substantial need exists for a system capable of protecting marina anchor posts from ice damage.

SUMMARY OF THE INVENTION

A first embodiment of a first aspect of the invention is a system for protecting a dock from ice damage. The system includes a circumferentially fluted, water-impermeable housing capable of longitudinal expansion and contraction. The housing defines a cavity with upper and lower openings into the cavity through the housing. The openings are configured and arranged to sealingly engage a dock-supporting post at longitudinally spaced upper and lower points along the length of the post.

A second embodiment of the first aspect of the invention is a system for protecting a dock from ice damage. The system includes a housing and a means for securing the housing to a dock-supporting post. The housing is a circumferentially fluted, water-impermeable, flexible housing capable of longitudinal expansion and contraction. The housing defines a sealed cavity surrounding a longitudinally extending central bore. The securing means is effective for securing the housing to a dock-supporting post with a longitudinal length of the post positioned within the bore.

A first embodiment of a second aspect of the invention is a method of protecting a dock from ice damage. The method involves (i) selecting a dock supported above a water line by a plurality of posts, (ii) obtaining a plurality of the systems described above as the first embodiment of the first aspect of the invention, and (iii) sealingly surrounding a length of each post with one of the housings at a position along the post whereby the housing sidewall extends above the water line and below a frost line.

A second embodiment of the second aspect of the invention is a method of protecting a dock from ice damage. The method involves (i) selecting a dock supported above a water line by a plurality of posts, (ii) obtaining a plurality of the systems described above as the second embodiment of the first aspect of the invention, and (iii) surrounding a length of each post with the sealed cavity of a housing at a position along the post whereby the housing sidewall extends above the water line and below a frost line.

DETAILED DESCRIPTION OF THE INVENTION INCLUDING A BEST MODE

Definitions

As utilized herein, including the claims, the phrase "water line" means the horizontal plane defined by the uppermost surface of a flat calm body of water.

As utilized herein, including the claims, the phrase "frost line" means the horizontal plane at the maximum depth below the water line to which ice normally forms atop a body of water during winter.

Nomenclature

10 Housing
11 Top Plate
12 Bottom Plate
13 Sidewall of Housing
19 Cavity Defined by Housing
21 First Orifice (Through Top Plate)
22 Second Orifice (Through Bottom Plate)
23 Access Port (Through Top Plate)
31 First Collar (Encircling the First Orifice)
32 Second Collar (Encircling the Second Orifice)
41 First Clamp
42 Second Clamp
50 Cap (Over Access Port)
60 Tube
69 Bore Through Tube
80 Foam
90 Antifreeze
100 Dock Anchor Post
201 Air
202 Ice
203 Water
301 Water Line
302 Frost Line

Construction

Figure 1:
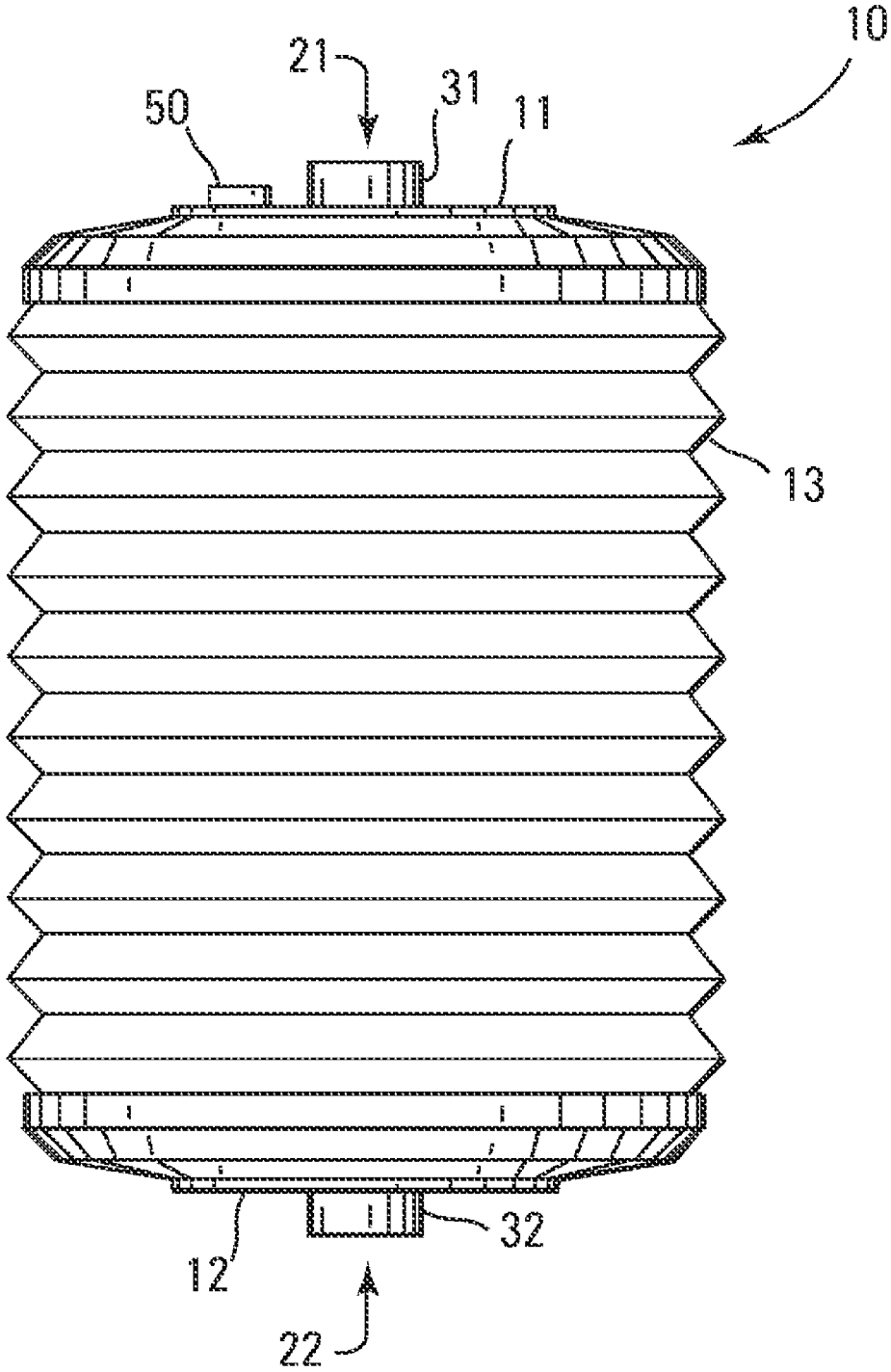
FIG. 1 is a side view of one embodiment of the invention.
Figure 3:
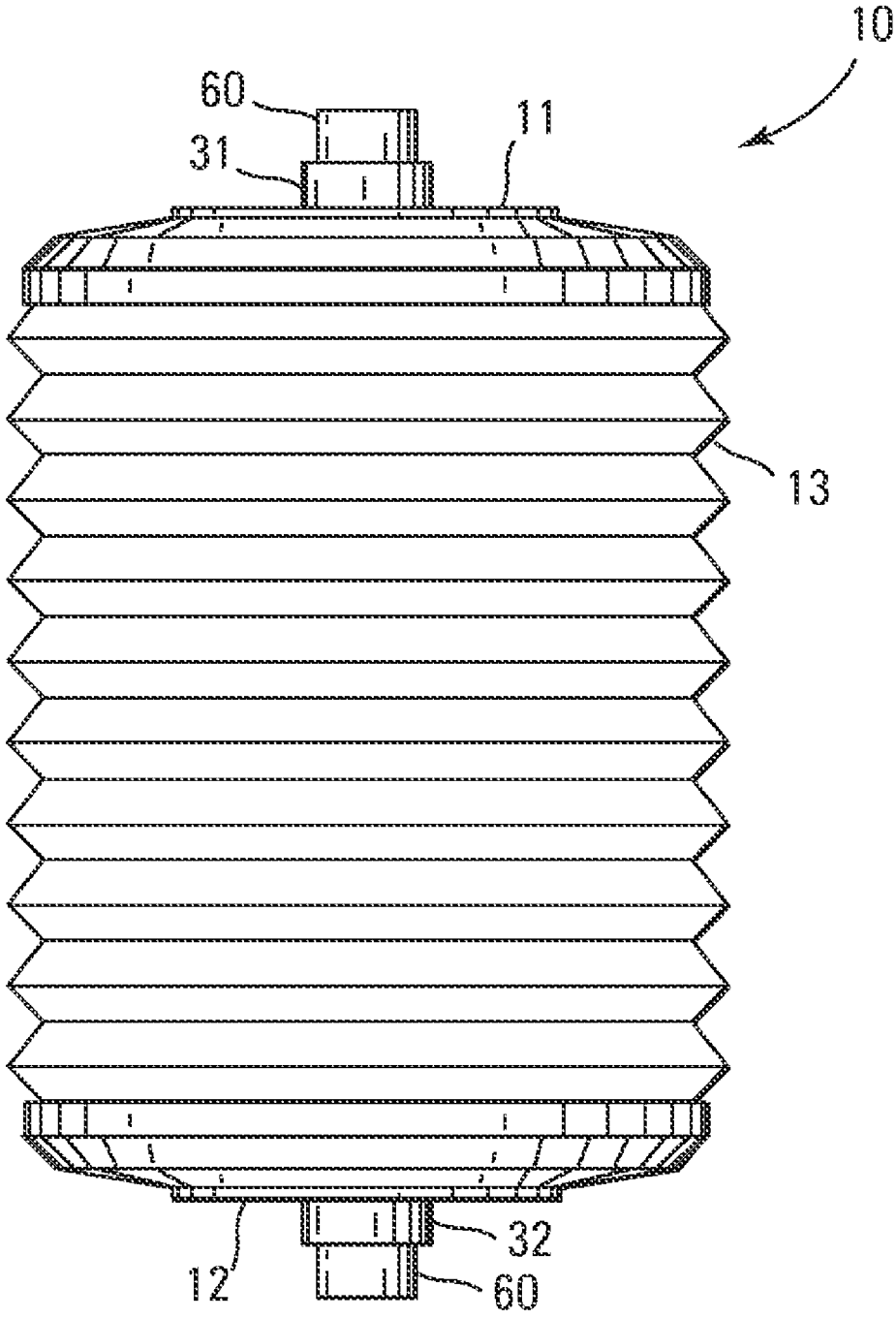
FIG. 3 is a side view of a second embodiment of the invention.

As shown in FIGS. 1 and 3, the invention includes a housing 10 which defines a cavity 19 capable of sealingly surrounding and isolating a defined length of a dock-supporting anchor post 100 from the surrounding aqueous environment. The housing 10 includes a top plate 11, a bottom plate 12, and a circumferentially fluted flexible sidewall 13. Longitudinally aligned orifices 21 and 22 are provided through the top plate 11 and bottom plate 12 respectively. The orifices 21 and 22 are in fluid communication with the cavity 19.

The housing 10 may have substantially any shape capable of surrounding a post 100 with a protective cavity 19. Suitable shapes include specifically, but not exclusively, a cube, a rectangular parallelepiped, a right circular cylinder, a frustum of right pyramid, a frustum of right cone, a circular barrel, a sphere or a conical ring. For most applications, the housing 10 should have a longitudinal z length of between about 0.5 to 3 meters, preferably, preferably between about 0.8 to 2 meters, and a circumference of between about 0.1 to 4 meters, preferably between about 1 to 2 meters.

The orifices 21 and 22 are sized to accommodate passage of a post 100 through both orifices 21 and 22 with minimal clearance to facilitate attachment of the housing to the post 100 proximate each of the orifices 21 and 22 so as to seal the cavity 19 around the post 100.

First and second collars 31 and 32 may be provided around each of the orifices 21 and 22 respectively to facilitate sealed engagement of the housing 10 to the post 100.

Suitable clamps, such as first and second hose clamps 41 and 42, are preferably employed around each of the collars 31 and 32 respectively, in order to seal the collars 31 and 32 against the pole 100.

By sealing the orifices 21 and 22, the cavity 19 is effective for isolating a defined length of the post 100 from the surrounding environment. By positioning the housing 10 along the longitudinal length of the post 100 so that the sidewall 13 extends above the water line 301 and below the frost line 302, the housing 10 serves to prevent the ice layer 202 from attaching directly to the post 100. The fluted nature of the sidewall 13 allows the sidewall 13 to be longitudinally and radially repositioned relative to the post 100 by those forces associated with the formation and shifting of an ice layer 202, and thereby attenuate the exertion of such forces upon the post 100.

If desired, the cavity 19 can be filled with a water-impermeable elastic foam 80 or an antifreeze solution 90 as an additional precaution against water leaking into the cavity 19. When the cavity 19 is filled with foam 80, a longitudinally extending bore (unnumbered) must be provided through the foam 80 in alignment with the orifices 21 and 22 to accommodate passage and retention of the defined length of post 100. When the cavity 19 is filled with antifreeze 90, the antifreeze preferably has a freezing point below −5° C., more preferably below −10° C., and most preferably below −20° C.

Figure 2:
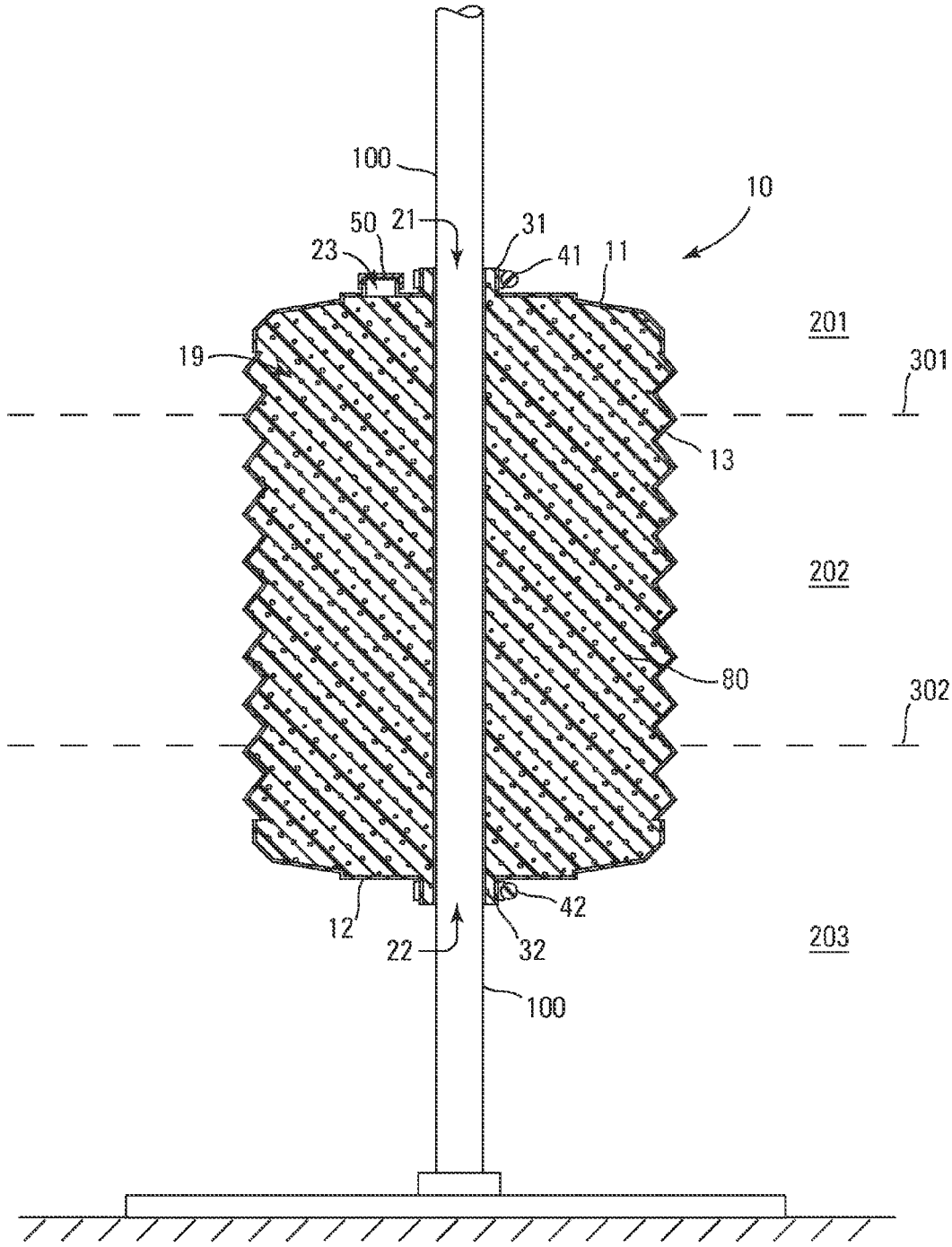
FIG. 2 is a cross-sectional side view of the invention shown in FIG. 1 filled with foam and attached to a dock anchor post about the water line.
Figure 4:
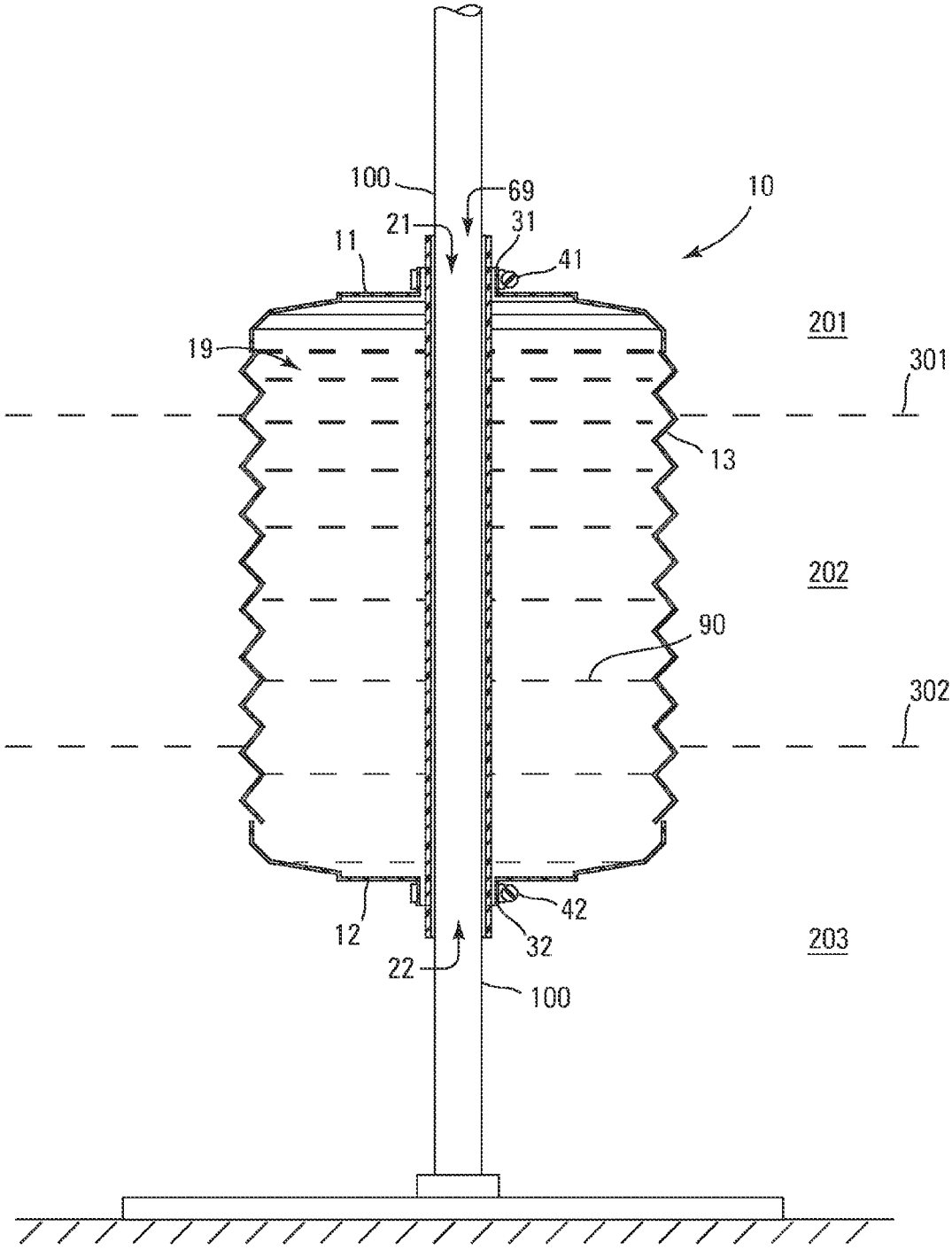
FIG. 4 is a cross-sectional side view of the invention shown in FIG. 3 filled with an antifreeze and attached to a dock anchor post about the water line.

A second embodiment of the invention is shown in FIGS. 2 and 4. The second embodiment of the invention is nearly identical to the first embodiment except that the orifices 21 and 22 are interconnected by a tube 60. Incorporation of the interconnecting tube 60 allows the cavity 19 to be sealed prior to positioning of the housing 10 onto a post 100 (i.e., sealed at the manufacturing facility). The housing 10 is positioned onto a post 100 by sliding the post 100 through a bore 69 in the tube 60. Since the orifices 21 and 22 in the housing 10 do not need to be sealed against the post 100, the housing 10 can be held in position by a single clamp, such as hose clamp 41, although use of two clamps 41 and 42 at each longitudinal end of the housing 10 is recommended to ensure a secure attachment and prevent the unattached end of the housing 10 from being pulled above the frost line 302.

The top plate 11 and bottom plate 12 of the housing 10 may be constructed from any waterproof material possessing the necessary structural integrity, including specifically, but not exclusively metals such as aluminum or steel, plastics such as polyethylene, polypropylene, polyvinyl chloride (PVC) or polyurethane, or rubber.

The fluted sidewall 13 of the housing 10 may be constructed from any waterproof, elastic material possessing the necessary structural integrity, including specifically, but not exclusively, plastics such as polyethylene or polypropylene, or rubber. In a preferred embodiment, the top plate 11, bottom plate 12 and sidewall 13 of the housing 10 are constructed as a single unitary piece from the same material, such as rubber.

The collars 31 and 32 may be constructed from any waterproof material possessing the necessary structural integrity, and when employed in the first embodiment of the invention capable of sealingly engaging a dock anchor post 100. Suitable materials including specifically, but not exclusively, plastics such as polyethylene and polypropylene, and rubber.

Use

The first embodiment of the invention can be employed to protect a dock from ice damage by sealingly surrounding that length of each post 100 between the water line 301 and the frost line 302 with one of the housings 10. The housing 10 is properly positioned along the length of the post 100 when the housing sidewall 13 extends above the water line 301 (i.e., into the air layer 201) and below the frost line 302 (i.e., into the water layer 203). In further detail, the first embodiment of the invention can be deployed on a post 100 already deployed within a body of water and attached to decking (not shown) by (i) detaching the post 100 from the decking, (ii) sliding the post 100 through orifices 21 and 22 in the housing 10, (iii) moving the housing 10 down the post 100 until only a few inches of the housing sidewall 13 is above the water line 301, (iv) placing the first clamp 41 around the first collar 31 and closing the clamp 41, (v) pulling the bottom plate 12 down the pole 100 into position below the frost line 302, (vi) placing the second clamp 42 around the submerged second collar 32 and closing the clamp 42, (vii) removing the cap 50 from the access orifice 23 in the top plate 11 of the housing 10, (viii) suctioning or siphoning any water which may have leaked into the cavity 19 during the process through the access orifice 23, and (ix) placing the cap 50 back over the access orifice 23.

The second embodiment of the invention can be employed to protect a dock from ice damage by surrounding that length of each post 100 between the water line 301 and the frost line 302 with one of the housings 10. The housing 10 is properly positioned along the length of the post 100 when the housing sidewall 13 extends above the water line 301 and below the frost line 302. In further detail, the second embodiment of the invention can be deployed on a post 100 already deployed within a body of water and attached to decking (not shown) by (i) detaching the post 100 from the decking, (ii) sliding the post 100 through bore 69 in tube 60, (iii) moving the housing 10 down the post 100 until only a few inches of the housing sidewall 13 is above the water line 301, (iv) placing the first clamp 41 around the upper exposed end (unnumbered) of the tube 60 and closing the clamp 41, and (v) placing the second clamp 42 around the submerged lower exposed end (unnumbered) of the tube 60 and closing the clamp 42.

If desired, the housing 10 could be constructed as a clamshell—pivotable about a longitudinal live-hinge (not shown) along the sidewall 13—so that the housing 10 could be attached directly into position on a post 100, thereby avoiding the need to detach the post 100 from any decking in order to attach the housing 10.

I claim:

1. A system for protecting a structure supported above a water-line by at least one post from ice damage, comprising (a) a bladder capable of longitudinal expansion and contraction when inflated for protectively encircling a submerged post from the water line to a frost line on the post, and (b) a means for securing the bladder to the partially submerged post with a portion of the bladder extending above the water line and a portion of the bladder extending below the frost line on the post.

* * * * *